US007559685B2

(12) United States Patent
Rosenmüller et al.

(10) Patent No.: US 7,559,685 B2
(45) Date of Patent: Jul. 14, 2009

(54) VEHICLE LAMP WITH INCREASED THERMAL STABILITY

(75) Inventors: Peter Rosenmüller, Plauen (DE); Jürgen Flechsig, Plauen (DE); Hans-Joachim Helmar Unger, Plauen (DE)

(73) Assignee: Koninlijke Philips Electronics N.V., Eindhoven (NL)

( * ) Notice: Subject to any disclaimer, the term of this patent is extended or adjusted under 35 U.S.C. 154(b) by 491 days.

(21) Appl. No.: 10/568,016

(22) PCT Filed: Aug. 4, 2004

(86) PCT No.: PCT/IB2004/051388

§ 371 (c)(1),
(2), (4) Date: Feb. 10, 2006

(87) PCT Pub. No.: WO2005/017945

PCT Pub. Date: Feb. 24, 2005

(65) Prior Publication Data

US 2008/0151568 A1 Jun. 26, 2008

(30) Foreign Application Priority Data

Aug. 15, 2003 (EP) ..... 03102558

(51) Int. Cl.
*H01R 33/00* (2006.01)

(52) U.S. Cl. ..... 362/647; 362/548; 362/549; 362/652; 313/318.01; 313/318.09

(58) Field of Classification Search ..... 362/548, 362/549, 647, 652, 655; 313/318.01, 318.09, 313/578

See application file for complete search history.

(56) References Cited

U.S. PATENT DOCUMENTS

| | | | | |
|---|---|---|---|---|
| 2,763,803 | A * | 9/1956 | Krefft et al. | 313/49 |
| 5,153,480 | A * | 10/1992 | Schoenherr et al. | 313/269 |
| 5,957,569 | A | 9/1999 | Helbig et al. | |
| 6,120,167 | A * | 9/2000 | Nace | 362/473 |
| 6,536,929 | B1 * | 3/2003 | Forgacs et al. | 362/519 |
| 6,932,491 | B2 * | 8/2005 | Esakoff | 362/650 |

* cited by examiner

*Primary Examiner*—Thomas M Sember

(57) ABSTRACT

A lamp includes a burner secured to a holding device made of metal. The lamp further includes a bottom section made of plastic. In order that the lamp is of a simple, mechanically stable design, and nonetheless is thermally stable, in accordance with a first aspect, an opening of the bottom section is provided with projections in such a way that a base sleeve made of metal, which is disposed in the opening, does not bear laterally against the bottom section over its entire surface. In accordance with a second aspect, the base sleeve includes a flange which screens a top side of the bottom section, at least partially, against the burner, wherein a space remains between the flange and the top side of the bottom section.

9 Claims, 4 Drawing Sheets

VEHICLE LAMP WITH INCREASED THERMAL STABILITY

The invention relates to a lamp, in particular a vehicle lamp, and to a vehicle headlight.

Known lamps are equipped with a burner, which comprises the actual light-generating element and takes the form of, for example, a glass bulb with one or more coiled filaments. Secured to the burner is a holding device made of metal. A bottom section is made of plastic and connected to the holding device. The bottom section serves for the positioning and mechanical retention of the lamp in a reflector. Also provided in the bottom section may be a connector unit for the electrical connection.

A vehicle lamp of this kind for installation in a reflector is known from U.S. Pat. No. 5,957,569. A burner is fixed in a metallic holder. A metallic sleeve is connected to the metallic holder and to a plastic bottom section. Provided in the plastic bottom section are the lamp's electrical terminals. The sleeve is anchored to the plastic bottom section. Prominent parts of the plastic bottom section are screened from the burner by metallic parts of the sleeve.

A general problem in the case of vehicle lamps with plastic bottom sections is that of thermal stability. A high thermal loading can lead to the decomposition, vaporization and/or outgassing of the plastic components. With the increasing miniaturization of headlamp housings, these problems are coming ever more to the fore. Visible vaporization, condensing onto reflector surfaces, impairs the function of the headlamp and, especially in the case of clear-glass headlamps, impairs their appearance.

The use of special plastics with a high thermal stability is conceivable. However, such materials are extremely expensive. If, in order to save costs, a base comprising multiple components is designed, wherein components located close to the burner comprise expensive, high-temperature resistant plastics, the problem of reduced mechanical stability of the base may result.

It is an object of the invention to propose a lamp with a simple, stable structure, which exhibits an improved thermal stability.

The lamp in accordance with the invention includes a base sleeve disposed in an opening in the plastic bottom section and thereby connected to it. On the other hand, the base sleeve is also connected to the metallic holder for the burner. The base sleeve thereby preferably forms the transition from the plastic bottom section to the metallic components of the lamp.

The invention provides that, although the base sleeve is accommodated in the opening of the bottom section, it does not bear against the bottom section over the entire surface, at least in an upper area. The reference to an "upper" and "lower" end hereby relates to an upright position of the lamp in which the burner is disposed at the top. These references serve only for clarification purposes and should not be taken as being restrictive.

Instead of an all-over contact of the base sleeve with the inside of the opening, the invention provides that projections are formed at this location, either on the base sleeve or on the inside of the opening, or both.

Contact of the sleeve with the base preferably takes place only at these projections, at least in the upper area. The heat transfer from the base sleeve, which has been strongly heated as a result of contact with the metallic components on the burner side, to the plastic bottom section is thereby greatly reduced, at least in the upper area.

The invention is hereby based on a recognition that it is primarily in the upper parts of the plastic bottom section that the thermal loading is particularly critical. When the lamp is mounted in the reflector, these areas are close to, or even within, the interior of the reflector housing. Owing to the higher temperatures and poor heat dissipation prevailing there, these locations are especially critical. In addition, outgassing can easily travel from there into the interior of the reflector.

Conversely, the lower end of the bottom section is located outside of the headlamp. The temperatures are considerably lower here. For this reason, it is the aim of the above-mentioned measures to enable heat to be conducted away from the hot upper edge of the bottom section into the colder lower area of the base.

Various options exist for designing the interior of the base sleeve in such a way that there is no all-over contact. For example, the projections may take the form of a number of lugs running longitudinally and/or transversely in relation to the opening. Alternatively, a number of punctiform elevations, distributed over the periphery, would also be conceivable. The base sleeve is then only ever in contact with the lugs or other elevations, and is located at a distance from the remaining areas of the interior of the opening. Direct contact between the two components is preferably limited to essentially linear or punctiform areas. The entire contact area preferably accounts for less than half of the entire outer surface of the sleeve in the upper area, for example.

The sleeve preferably assumes a cylindrical form with, for example, a circular cross-section. The interior of the opening may hereby be designed with projections of this kind over the entire area that is in contact with the base sleeve. However, it is also possible for this to be the case only in the critical upper area. This upper area may, for example, comprise more than a quarter, and preferably more than a half, of the overall length of the sleeve. Additionally or alternatively, it is also possible to provide the base sleeve with projections, e.g. lugs and/or punctiform elevations, on its exterior, these again being over the entire area or only over the upper area.

In accordance with the invention, the base sleeve is designed with a flange, preferably at its upper end. This flange covers the top side of the bottom section at least partially. The entire top side of the bottom section is preferably screened from the burner by this flange. In order to avoid a severe heat transfer at this point, the flange is disposed in such a way that it runs at a distance from the top side of the bottom section.

The top side of the bottom section is preferably essentially annular at this point. The flange preferably covers the entire ring. The flange preferably further exhibits at its outer periphery a chamfered bend that overlaps the top side of the bottom section.

With the screening by the flange in accordance with the invention, a high temperature loading on the particularly critical top side of the plastic bottom section is prevented. Owing to the remaining space between the flange and the top side, the heat transition is minimized. In addition, an attractive appearance is obtained owing to the fact that no plastic is visible through the metallic cladding into the interior of the reflector.

Each of the embodiments described above is separately regarded as a solution to the object of the invention. However, they may also be combined in an especially advantageous manner. With both solutions, the metal of the base sleeve runs, in part, at a distance from the plastic bottom section, so the heat transfer in the especially critical upper area is greatly reduced.

As a possible further development of the invention, it is preferred that the base sleeve is mainly accommodated in the bottom section. Owing to the accommodation of the base sleeve in the plastic bottom section at the lowest possible level, the heat dissipation down to the lower, colder areas of the base is improved. The base sleeve may thus extend into the base bottom section as far as, for example, more than half the entire longitudinal extent of the latter. The opening in the bottom section preferably takes the form of a central opening with, for example, a circular cross-section.

At its lower end, the base sleeve preferably takes the form of a floor. The surface of this floor may be in contact with that of the plastic material. At this location, which is relatively cold owing to the distance from the burner and the position outside of the headlamp, any heat transition from the base sleeve to the plastic is largely uncritical.

In an alternative embodiment, a base sleeve disposed in the central opening is again provided. Here again, the base sleeve forms the transition between the temperature-loaded metallic holder and the plastic bottom section.

A further development of the invention provides that cooling fins or slots are provided on the exterior of the bottom section. These may, for example, run longitudinally and/or transversely. They serve to enlarge the surface and thus to improve the heat dissipation to the outside.

The invention will be further described with reference to examples of embodiments shown in the drawings, to which, however, the invention is not restricted.

FIG. 1 shows a side view of a vehicle lamp.

FIG. 1*a* shows a sectional view of the section A..A from FIG. 1.

FIG. 2 shows a side view of a bottom section of the lamp from FIG. 1.

FIG. 2*b* shows a sectional view of the section B..B from FIG. 2.

Figure 1:
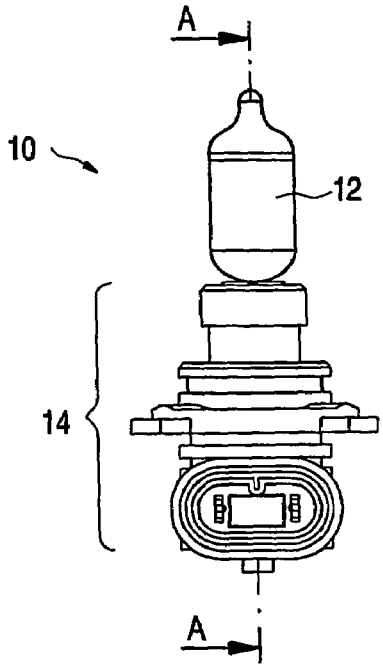
Figure 1A:
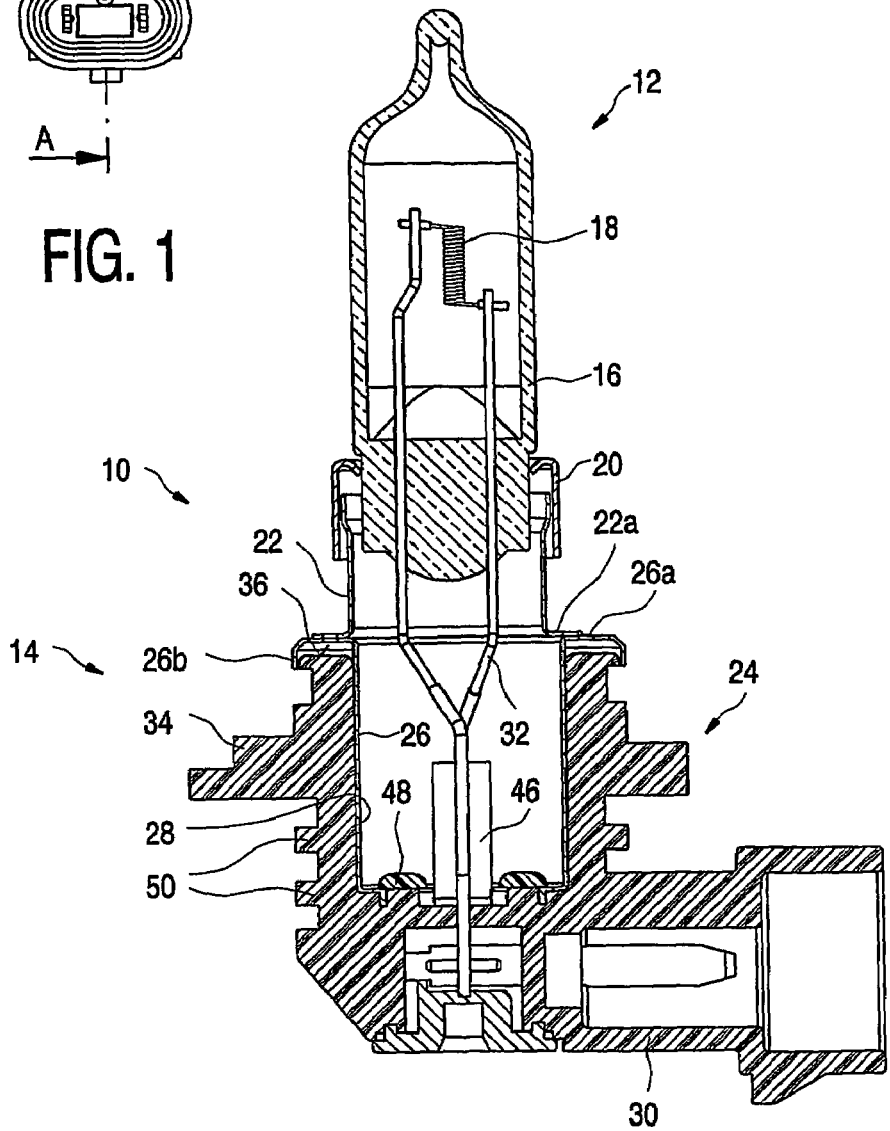

FIGS. 1 and 1*a* show, in a side view and sectional view respectively, a lamp 10 as one embodiment of the invention. The lamp is equipped with a burner 12, which is secured in a base 14.

In the embodiment shown, the lamp is a filament lamp. The burner 12 comprises a glass bulb 16 with a coiled filament 18 disposed within it. The bulb 16 is retained in a clip-type holder 20. The clip-type holder 20 is pulled over an adjusting sleeve 22.

The base 14 is also equipped with a plastic bottom section 24 and a base sleeve 26 inserted into it. At its upper end, the base sleeve 26 takes the form of a flange 26*a*, which exhibits a chamfered bend 26*b* at the periphery. At its lower end, the adjusting sleeve 22 takes the form of a flange 22*a*. The adjusting sleeve 22 and the base sleeve 26 are located one upon the other and connected at their respective flanged parts 22*a*, 26*a*.

The base bottom section 24 comprises an opening 28, running centrally in the longitudinal direction of the lamp 10, into which opening the base sleeve 26 is inserted. The base bottom section further comprises a connector unit 30. As can be seen in FIG. 1*a*, connecting lines 32 are routed from the ends of the coiled filament 18, out of the bulb 16, through the adjusting sleeve 22 and the base sleeve 26, and up to the connector unit 30. In the example shown, the connector is disposed at right-angles relative to the longitudinal axis of the lamp 10.

Figure 3:
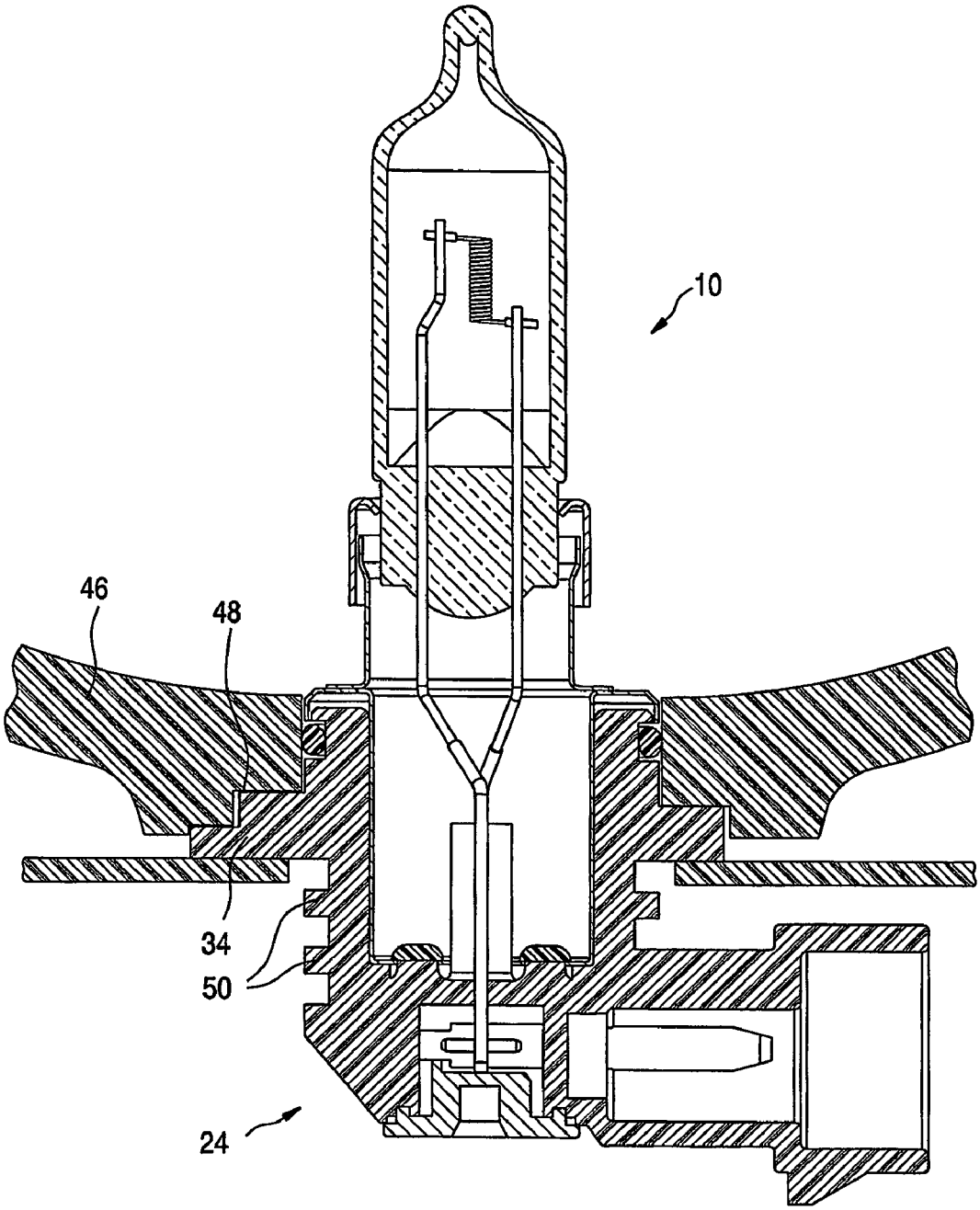
FIG. 3 shows a sectional view of the lamp from FIG. 1 in a reflector.

The base bottom section 24 is surrounded by a flange profile 34. The flange profile 34 serves, in a manner that is known per se, for the positioning and fixing of the lamp 10 on a reflector. FIG. 3 shows, in a sectional view, how the lamp 10 is positioned on a reflector 46, of which only part is shown here. The flange profile 34 engages in a corresponding cut-out 48 on the reflector 46, so that the lamp 10 is in position.

As shown in FIG. 1*a*, the burner 12, with the metallic holder comprising the clip-type holder 20 and the adjusting sleeve 22, is accommodated on the base 14 so as to be adjustable in direction. The clip-type holder 20 and the adjusting sleeve 22 are hereby telescopically connected. When the lamp 10 is produced, following the initial assembly of the components, directional adjustment takes place, in which a predetermined position of the filament 18 is assumed. During the direction-adjusting procedure, the burner may be tilted by a small amount relative to the reference element (flange profile 34) that determines the subsequent position on the reflector. A slight shift in the direction of the longitudinal axis is also possible (telescopic mounting). An additional alignment option derives from the positioning, one above the other, of the flange components 22*a*, 26*a* of the adjusting sleeve 22 and the base internal sleeve 26. Here, the burner may be shifted in the transverse direction relative to the reference 34 during the alignment. Overall, an alignment in 6 axes is thus possible. Following the alignment, the metallic components—the clip-type holder 20, the adjusting sleeve 22 and the base internal sleeve 26—are permanently connected together, e.g. by welding.

The invention pays particular attention to the thermal stability of the lamp 10, and in this case especially to the thermal loading on the plastic bottom section 24. The heat generated when the coiled filament 18 is in operation is emitted, on the one hand as radiant heat at the base 14. On the other, heat conduction also takes place through the metallic components 20, 22. As a result, temperature problems may arise, primarily in the upper area of the plastic bottom section 24, in particular at the upper boundary edge 36.

In order to counteract this problem, on the one hand, the flange 26*a* formed by the base sleeve 26 is provided for the lamp 10. The flange 26*a* covers the top edge 36 of the bottom section 24. The edge 36 is thereby screened from the burner 12. However, the flange 26*a* does not rest directly on the edge 36, but runs at a small distance away from it. As a result, any excessive heat conduction from the base internal sleeve 26 into the upper area of the bottom section 24 is prevented. The space between the flange 26*a* and the upper edge 36 is approximately 1 mm hereby. This distance may, however, be selected to be e.g. within the range from 0.5 mm to 5 mm, depending on the application.

The flange 26*a* further exhibits at its periphery a further chamfered bend 26*b*, which encompasses the upper edge 36 of the bottom section 24. Complete coverage is ensured as a result. The distance between the bend 26*b* and the upper edge 36 is 0.3 mm in the example shown. This distance may be selected to be e.g. between 0.2 and 1 mm. The groove shown serves in the example to accommodate a sealing ring and is designed in such a way that the sealing ring does not come into contact with the metal of the bend 26*b*, as shown in FIG. 2*b*.

Figure 2:
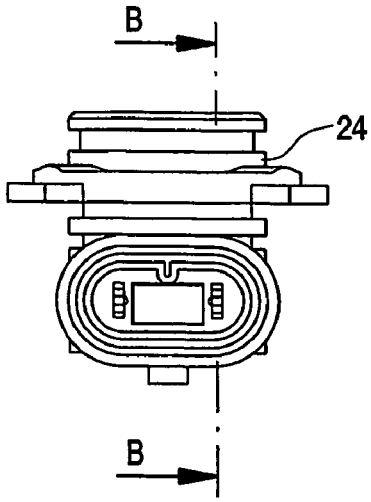
Figure 2B:
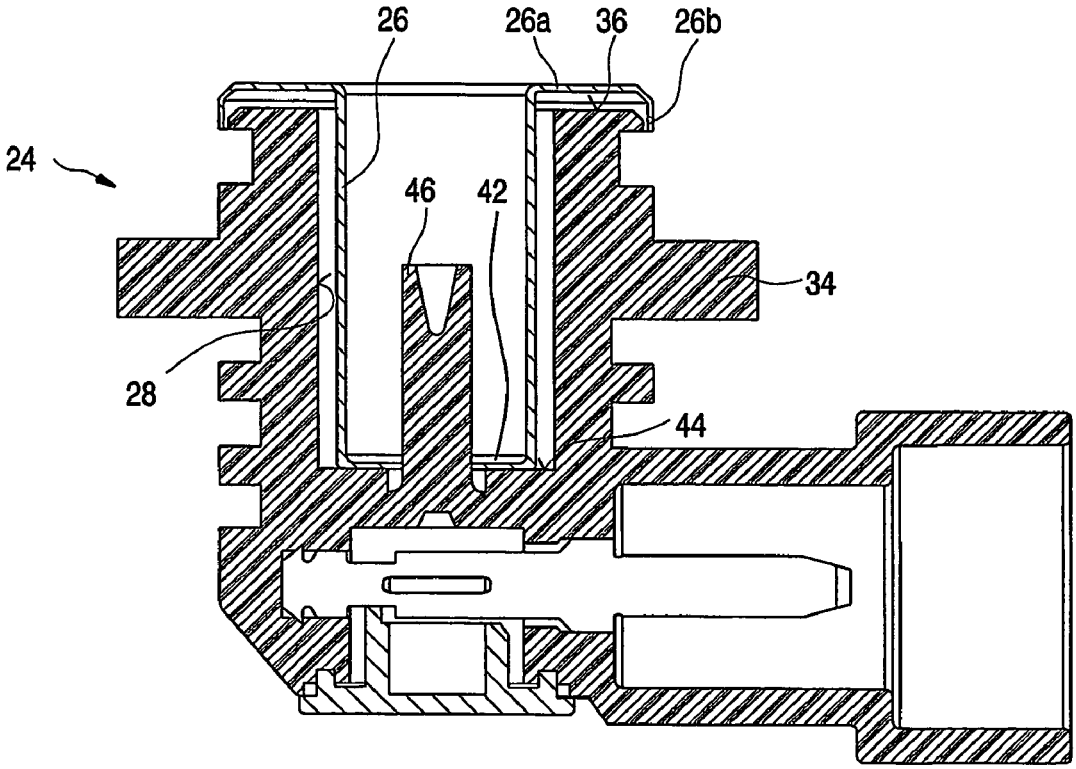

On the other hand, a second measure to reduce the heat transfer from the base sleeve 26 into the base bottom section 24 is shown in FIGS. 2, 2*b*, 4 and 5. FIG. 2*b* hereby shows a sectional view, wherein the section is taken along a line B..B at a distance from the central axis, as shown in FIG. 2.

Figure 4:
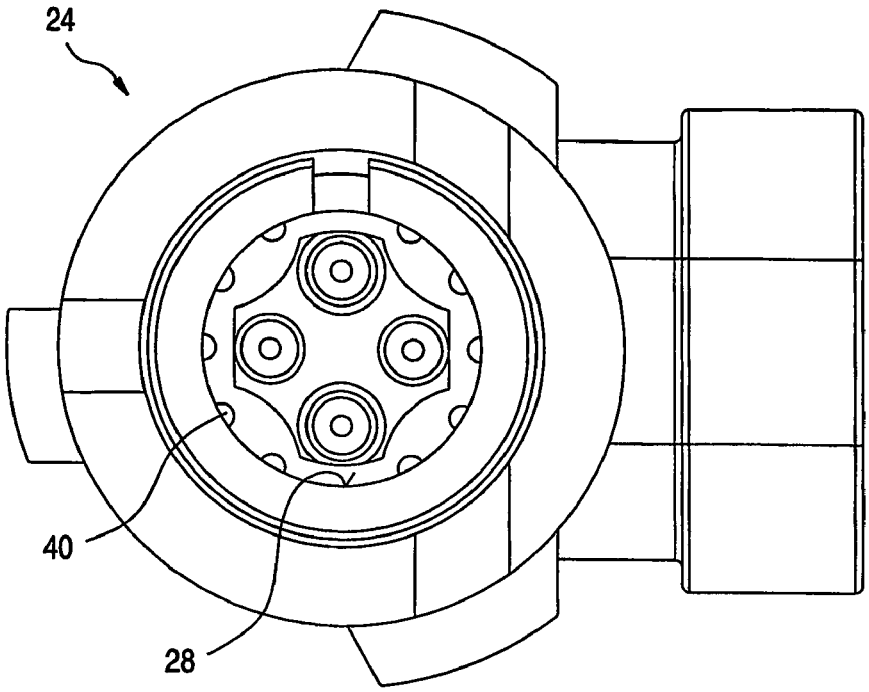
FIG. 4 shows a plan view of the bottom section from FIG. 2 without the base sleeve.

It becomes clear from FIG. 2*b* that, along its periphery, the base internal sleeve 26 does not connect with the bottom section 24 over its entire surface. In the sectional plane B . . . B, a space remains between the base internal sleeve 26 and the inside of the opening 28. The reason for this is apparent from the plan view shown in FIG. 4. The base bottom section 24 is shown in FIG. 4 without the base sleeve 26 inserted. A number of lugs 40 with a semi-circular cross-section are formed on the inside of the opening 28, running in the longitudinal direction from the floor of the opening 28 up to the upper edge 36 of the bottom section 34. The lugs 40 are formed integrally with the plastic bottom section 34. The sleeve 26 bears against the top of the lugs 40. Since a number of lugs—ten in the example shown—are evenly distributed over the periphery, the sleeve 26 is well anchored within the bottom section 34. Simultaneously, however, the direct contact of the plastic material of the bottom section 34 with the metal of the sleeve 26 exists only over relatively small contact surfaces, specifically along the crests of the lugs 40 (essentially linear contact).

On the other hand, however, the base internal sleeve 26 exhibits a lower floor 42, which is in direct surface contact with the plastic material at a base 44 of the opening 28. As shown in FIGS. 1*a* and 2*b*, a conductor arrangement 46 projects from below through the floor 42 of the sleeve into its interior. In addition, in its floor 42, the sleeve exhibits four openings, through which plastic posts 48 extend. After the sleeve 26 has been inserted, the posts 48 are fused on or suitably mechanically connected, e.g. caulked, so that a permanent connection of the sleeve 26 with the bottom section 34 arises.

Figure 5:
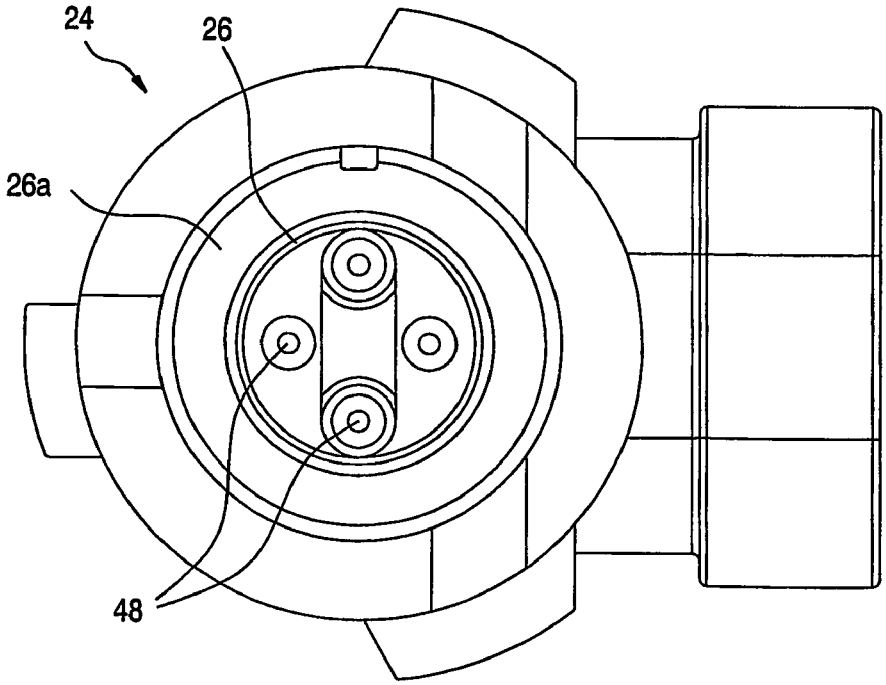
FIG. 5 shows a plan view of the bottom section from FIG. 2 with the base sleeve in place.

Finally, FIG. 5 shows the base 24 with the inserted sleeve 26. It is clearly apparent how the upper edge 36 of the base bottom section is completely screened from this direction by the flange 26*a*.

Accordingly, with the base shown in the Figures, very little contact exists between the sleeve 26 and the upper part, in particular the upper edge 36, of the plastic bottom section 34, so that only a comparatively negligible heat transfer takes place here. At the base of the sleeve 26, on the other hand, there is contact between the two elements over a large surface area, so the heat transfer will be greater here.

On its exterior, the plastic bottom section 24 is equipped with cooling fins. This improves the heat dissipation.

The way in which the lamp 10 is accommodated on the reflector 46 is shown in FIG. 3. No plastic components are visible inside the reflector 46—the upper edge 36 of the base bottom section 24 is completely covered by the flange 26*a* and the bend 26*b*.

The underside of the base bottom section 24 is disposed outside the reflector 46 and therefore is located, while in operation, in an area with low temperature criticality. The cooling fins 24 are disposed outside the reflector in this area. The base sleeve 26 extends into the base bottom section 24 far enough that the part of the base sleeve 26 that is in all-over contact with the bottom section 24—the floor 42 in the example shown—is disposed outside the reflector 46.

The design shown thus enables heat conduction to take place away from the "hot" areas on the reflector, so that high temperature loadings are prevented.

Measurements taken on prototypes have revealed that, owing to the above-described measures, the temperature loading on the plastic material is strongly reduced, especially in the upper area 36. A relatively cost-effective plastic material can therefore be used.

A number of variations of the embodiment explained above are conceivable. Thus, as the light-generating element, the burner may comprise a discharge tube for producing a gas discharge, rather than a coiled filament. Further variations are conceivable in the design of the interior of the opening 28. The shape, position and number of the lugs 40 may vary. Instead of lugs 40 running longitudinally, lugs running around radially or punctiform elevations may also be provided. The elevations may be provided both on the plastic component and on the base sleeve.

Finally, it is also possible that the area of non-full-surface contact between the sleeve 26 and the opening 28 does not, as in the example shown, extend over the entire length of the opening 28. In some circumstances, it may be sufficient to provide the elevations 40 only in an upper area of the opening 28. It is hereby preferred if this upper area extends into a position outside the reflector.

The invention claimed is:

1. A lamp comprising:

a burner, a holding device made of metal, which is secured to the burner, and a bottom section made of plastic, wherein the bottom section includes an opening, a base sleeve made of metal disposed in the opening, the base sleeve being connected to the holding device, wherein, at least in an upper area of the base sleeve facing towards the burner, an inner wall of the opening and/or an exterior of the base sleeve is provided with projections such that the base sleeve, along a periphery thereof, does not bear against the bottom section over an entire surface thereof.

2. The lamp as claimed in claim 1, wherein the projections have a form of either a number of lugs running longitudinally and/or transversely in relation to the opening, or of punctiform elevations.

3. The lamp as claimed in claim 1, wherein the base sleeve is mainly accommodated in the bottom section.

4. The lamp as claimed in claim 1, wherein the bottom section is integrally produced from plastic.

5. The lamp as claimed in claim 1, wherein the base sleeve takes a form of a floor at its lower end facing away from the burner, and wherein the floor is in contact with the plastic material of the bottom section.

6. The lamp as claimed in claim 1, further comprising cooling fins or cooling slots on an exterior of the bottom section.

7. A vehicle headlamp comprising:

a reflector, and a lamp fitted on the reflector as claimed in claim 1, wherein the burner is located inside the reflector housing, and the bottom section of the lamp is located mainly outside the reflector housing.

8. A lamp comprising:

a burner;

a holding device secured to the burner; and a bottom section that includes an opening;

a base sleeve disposed in the opening, the base sleeve being connected to the holding device;

wherein, at least in an area of the base sleeve facing towards the burner, an inner wall of the opening and/or an exterior of the base sleeve is provided with projections such that the base sleeve, along a periphery thereof, does not bear against the bottom section over an entire surface thereof; and wherein at the upper area, the base sleeve has a flange, which screens a top side of the bottom section, at least partially, against the burner.

9. The lamp as claimed in claim 8, wherein a space remains between the flange and the top side.

* * * * *